US010946503B2

(12) United States Patent
Kramer et al.

(10) Patent No.: US 10,946,503 B2
(45) Date of Patent: Mar. 16, 2021

(54) CLIP TOOL

(71) Applicants: Pearce Carleton Kramer, Peachtree City, GA (US); Kristopher Kent Kramer, Peachtree City, GA (US)

(72) Inventors: Pearce Carleton Kramer, Peachtree City, GA (US); Kristopher Kent Kramer, Peachtree City, GA (US)

(73) Assignee: THE ROCK ENGINEERING, INC, Peachtree City, GA (US)

( * ) Notice: Subject to any disclaimer, the term of this patent is extended or adjusted under 35 U.S.C. 154(b) by 258 days.

(21) Appl. No.: 15/979,148

(22) Filed: May 14, 2018

(65) Prior Publication Data

US 2019/0344413 A1 Nov. 14, 2019

(51) Int. Cl.

| | |
|---|---|
| ***B25B 31/00*** | (2006.01) |
| ***B25D 1/16*** | (2006.01) |
| ***B25B 27/14*** | (2006.01) |
| ***B25D 1/06*** | (2006.01) |
| ***B25F 1/00*** | (2006.01) |
| *B44D 3/12* | (2006.01) |
| *B25G 1/10* | (2006.01) |

(52) U.S. Cl.

CPC ..... *B25B 31/00* (2013.01); *B25B 27/146* (2013.01); *B25D 1/06* (2013.01); *B25D 1/16* (2013.01); *B25F 1/006* (2013.01); *B25G 1/102* (2013.01); *B44D 3/127* (2013.01)

(58) Field of Classification Search

CPC ..... B25B 27/146; B25B 31/00; B25B 33/00; B25C 5/0285; B25C 5/045; B25C 5/085; B25C 5/11; B25C 11/00; B25D 1/00; B25D 1/04; B25D 1/045; B25D 1/06; B25D 1/16; B25F 1/006; B25G 1/04; B44D 3/127

See application file for complete search history.

(56) References Cited

U.S. PATENT DOCUMENTS

| | | | | |
|---|---|---|---|---|
| 4,903,882 | A * | 2/1990 | Long | B25C 3/006 227/147 |
| 5,370,293 | A * | 12/1994 | Bevins | B25C 3/006 227/147 |
| 9,085,073 | B2 * | 7/2015 | Hossack | B25C 3/008 |
| 2009/0188051 | A1 * | 7/2009 | Simmons | E04H 17/268 7/143 |
| 2010/0024605 | A1 * | 2/2010 | Hiltz | B62D 53/0857 81/20 |
| 2013/0200129 | A1 * | 8/2013 | Paddock | B25C 5/10 227/63 |

* cited by examiner

*Primary Examiner* — Ryan A Reis

(57) ABSTRACT

A tool for assisting in the installation and/or removal of clips. The tool can include a handle and a tool head attached to the handle. The tool head includes a clip abutment portion having at least one surface operable to substantially abut at least a portion of a clip. A magnet in the tool head is configured to retain the clip proximate to the clip abutment portion such that a user can utilize a tool to apply a clip to an article. The tool head can also include a clip extrication element to facilitate removal of installed clips.

12 Claims, 4 Drawing Sheets

CLIP TOOL

FIELD OF THE INVENTION

This specification is related generally to a tool for assisting in the installation and/or removal of clips.

BACKGROUND

Clips may be used to secure one or more articles together. For instance, a clip may be constructed of a semi-rigid material and may secure two articles together through application of pressure on the articles such that they remain affixed with respect to each other. One type of clip is a can clip that secures the lid of a can to the body of a can. An example of a can clip is a paint can lid clip. Paint lid clips are commonly used during transport of paint cans to ensure that the paint can lids do not become disengaged from paint cans, for instance, during movement or shipment. Can clips, such as paint can lid clips, are often installed by hand, which is inefficient and slow because clips may require a tight fit and thus, substantial pressure or force for installation. Additionally, installing numerous clips in sequence may cause soreness, injury, and/or fatigue due to the finger strength necessary to apply clips. Further, many clips may include sharp edges and/or may shed metal residue, which is undesirable for application by hand.

SUMMARY

The present invention relates to a tool for assisting in the installation and/or removal of clips.

In a first aspect, a tool includes a handle, and a tool head attached to a first end of the handle. The tool head includes a clip extrication element that includes a tip, a clip retaining portion that includes a clip abutment portion having at least one surface operable to substantially abut at least a portion of a clip, and a magnet, where the magnet is configured to retain the clip proximate to the clip abutment portion.

Implementations can include any, all or none of the following features. The tool head can be positioned substantially perpendicular to a longitudinal axis of the handle. The tool can also include a harmer head attached to a second end of the handle, where the second end of the handle is opposite the first end of the handle. The hammer head can include a hammering surface positioned substantially perpendicular to the longitudinal axis of the handle. Additionally, the magnet can be disposed within the clip abutment portion. The clip extrication element and clip abutment portion can be formed from a single piece of material.

According to another feature, the tip can include a tapered portion. The clip retaining portion can include a surface having a concave bend forming a receptacle for receiving the clip. Further, the clip extrication element can include a tapered portion. The tapered portion can be V-shaped. The tool can also include a neck, located between the handle and the tool head, where the neck attaches the tool head to the handle. According to yet another feature, the tip can be disposed at a first end of the clip extrication element, where the first end is located opposite a second end of the clip extrication element, and where the second end of the clip extrication element is proximate to the clip retaining portion. The tip can include a bent portion, where the bent portion of the tip is pointed toward the handle.

In another aspect, a tool includes a handle, and a tool head, attached to a first end of the handle. The tool head can be attached to a first end of the handle and can include a clip extrication element, a clip retaining portion, and a retaining element. The clip extrication element can include a tapered portion and a tip at a distal end of the clip extrication element. The clip retaining portion can include a curved surface and a flat surface, where the curved surface and flat surface form a homogeneous surface. The retaining element can be disposed within the clip retaining portion, for encasing a clip.

Implementations can include, any, all or none of the following features. The tool can include a hammer head, attached to a second end of the handle. The second end of the handle can also include a hammer end. The tip can include a bent portion pointing toward the handle. The tool can further include a neck, affixed to the handle at a first end, and affixed to the tool hand at a second end opposite the first end, to the handle. Additionally, the retaining element may include a magnet, operable to engage a clip constructed of a ferromagnetic material. The clip extrication element and clip retaining portion of the tool can be formed from a single piece of material.

In yet another aspect, a tool can include a handle and a tool head, attached to a first end of the handle. The tool head includes a clip retaining portion, the clip retaining portion including a clip abutment portion having a surface operable to substantially abut at least a portion of a clip, where the surface includes a substantially flat surface and a curved surface. The clip retaining portion also includes a magnet, disposed within the clip abutment portion, where the magnet is configured to retain the clip proximate to the clip abutment portion. In one implementation, the tool can further include a hammer head, attached to a second end of the handle. In another implementation, the tool can include a clip extrication element, attached to a second end of the handle, where the clip extrication element includes a narrow tip.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
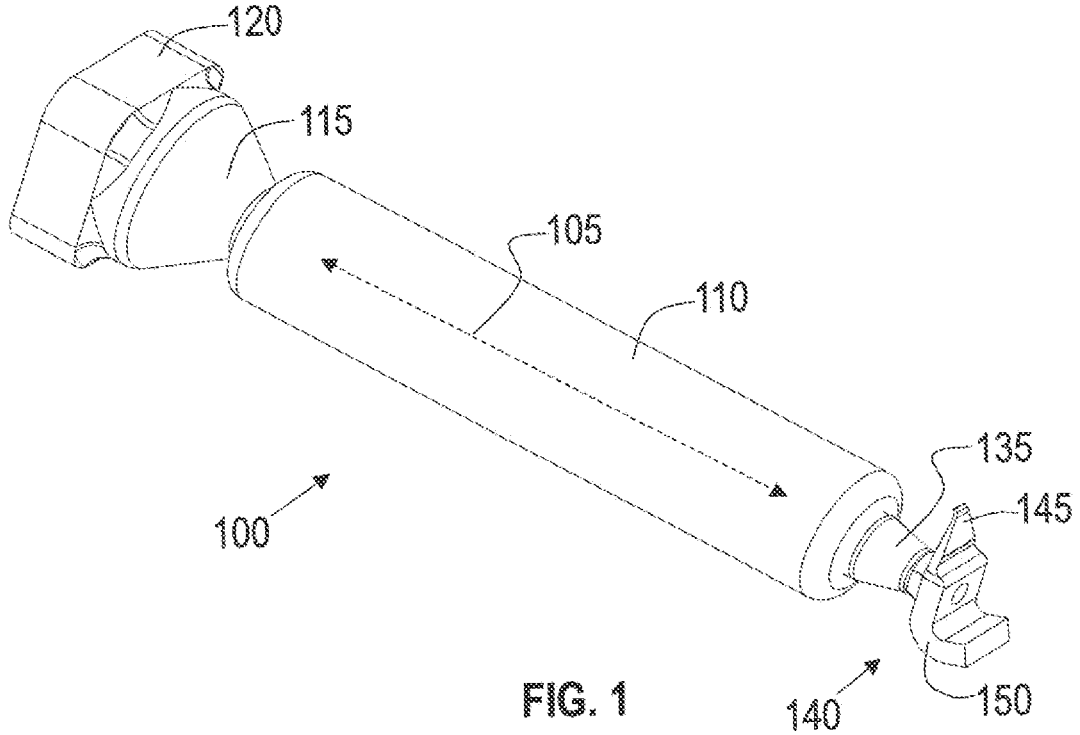
FIG. 1 shows a perspective view of an example clip tool.

FIG. 1 shows a perspective view of an example tool 100. The tool 100 includes a handle 110 and a tool head 140 attached by a neck 135 to the handle 110 at one end of the handle 100. At the opposite end of the handle 110 is a hammer head 120 that can be attached to the handle 110 by a head support 115. The tool 100 facilitates the installation and removal of clips, such as can lid clips. The tool head 140 includes a clip retaining portion 150 including a curved portion and a substantially flat portion operable to abut one or more surfaces of a clip, for use in securing and applying force to a clip during clip installation. The tool head 140 also includes a clip extrication element 145 to facilitate the removal to clips, such as clips from can lids. The clip extrication element 145 can be used for other purposes, such as for removing lids from cans. The hammer head 120 can be used for staking clips into place and/or for other uses, such as securing a lid to a can.

The handle 110 extends along a longitudinal axis 105 and is of such length to allow the handle 110 to be held by hand. The handle 110 can be constructed of a umber of tool materials, which include steel (including, but not limited to a high carbon, heat-treated steel, and allow steel), iron, nickel, a composite material, aluminum, plastic, wood, fiberglass, rubber, carbon fiber, or a combination of one or more such materials. The tool materials can also include magnetic materials. While the example tool 100 shown in FIG. 1 shows a handle 110 that may be constructed entirely from a single material, such as steel, the handle can also be constructed of multiple materials, including materials to facilitate grip and/or make the handle 110 more comfortable to grasp. For instance, the handle 110 can be constructed of a central member (not shown) constructed from one or more handle materials, and a covering material secured to the central member. The covering material may be constructed from one or more materials including, but not limited to, plastic, leather, synthetic rubber, high-impact resins, elastomeric compounds, and the like. Further, the handle 110 can be constructed to include one or more recesses, indentations, and/or protrusions to enhance the grip of the handle 110. The handle 110 can be ergonomically shaped. In other implementations, the handle 110 can be designed to be narrow to reduce the overall weight of the tool 100 or may have other features to reduce its overall weight, such as holes or the like.

In the example tool 100 shown in FIG. 1, one end of the handle 110 is secured to a head support 115 that attaches the handle 110 to the hammer head 120. The head support 115 separates the hammer head 120 from the handle 110 in a direction alone; the longitudinal axis 105. In other implementations, the tool 100 can be constructed without the head support 115 such that the hammer head 120 is directly affixed to the end of the handle 110. In yet other implementations, the hammer head 120 may be integrated into the end of the handle 110. The hammer head 120 and head support 115 can be constructed from one or more tool materials as described above. Although the head support 115 of the example tool 100 shown in FIG. 1 is conical in shape, it will be appreciated that any shape could be used for the head support 115 to attach the hammer head 120 to the handle 110. Additionally, while the side portions of the hammer head 120 in the example tool 100 of FIG. 1 are shown as collectively forming a substantially square shape with rounded edges, it will be appreciated that the shape of hammer head 120 may take many forms, so that its cross-sectional shape in a plane perpendicular to the longitudinal axis 105 may be circular, rectangular, or the like. Furthermore, the hammer head 120 may be constructed from a different tool material than the head support 115 and/or handle 110, such as a stronger, less malleable, and/or more resilient material capable of striking objects without deforming. In some implementations, the hammer head 120 and/or head support 115 can also be constructed to be removable from the handle 110 such as through a threaded coupling or the like.

In the example tool 100 shown in FIG. 1, a tool head 140 is secured to an end of the handle 100 opposite the end of the handle that is attached to the head support 115. The tool head 140 is secured to the handle 110 by a neck 135 that can be constructed from one or more tool materials as described above. The neck 135 expends in a direction along the longitudinal axis 105 and separates the tool head 140 from the handle 110. In other implementations, the tool head 140 may be attached directly to the handle 110. The tool head 140 of the example tool 100 is operable to retain clips and assist in the application of a clip to an article. For instance, the tool head 140 may held a can lid clip to provide leverage, via the handle 110 to make the process of applying the can lid clip to a can lid more efficient. The tool head 140 can also include assist in the removal of clips from articles to which clips have been secured. As shown in FIG. 1, as some implementations the tool head 140 can be fixed in position with respect to the handle 110 such that it is oriented substantially perpendicular to the longitudinal axis 105 of the handle 110.

The tool head 140 includes a clip retaining portion 150. In some implementations, the clip retaining portion 150 includes a curved surface and a flat surface, together forming a homogeneous surface for retaining a clip. The clip retaining portion 150 shown in FIG. 1 includes a bottom surface that defines a clip abutment portion 155 that is proximate to a clip when the tool 100 is used to apply a clip. The clip retaining portion 150 includes a concave bend forming a receptacle for receiving a clip. In some implementations, the clip retaining portion 150 is configured to mimic the shape of one or more sides of clip, or clips, such that the clip and clip abutment portion 155 are congruent along the one or more sides of the clip when the clip is directly adjacent the clip retaining portion 150. The clip retaining portion 150 may mimic the shape of one or more sides or clips having various sizes. The clip retaining portion 150 can be constructed of one or more tool materials, as described above. Further, although the tool head 150 shown in FIG. 1 is fixed in position with respect to the handle 110, in other implementations the tool head 140 may be removable such that different tool heads may be secured to the handle 110, which may be useful to accommodate different shapes and/or sizes of clips. As an example, the tool head 140 may be threaded into a receptacle within the neck 135 to facilitate removal and replacement of the tool head 140 with a tool head having a different size or shape.

The tool head 140 also includes a clip extrication element 145 that is constructed from one or more tool materials. The clip extrication element 145 can be V-shaped. Further, the clip extrication element 145 can include a tapered portion, such that the distal end of the clip extrication element 145 furthest from the neck 135 may be thinner than the portion nearest the neck 135. The tapered portion helps facilitate the insertion of the clip extrication element 145 in a small space underneath an object, such as clip that has been applied to an article. In some implementations, the clip extrication element 145 and the clip retaining portion 150 are formed from a single piece of material. For instance, the clip extrication element 145 and the clip retaining portion 150 may be machined or cut from a single piece of steel. In other implementations, the clip extrication element 145 and the clip retaining portion 150 may be constructed of more than one tool material and joined using pins, screws, welds, or similar techniques.

Figure 2:
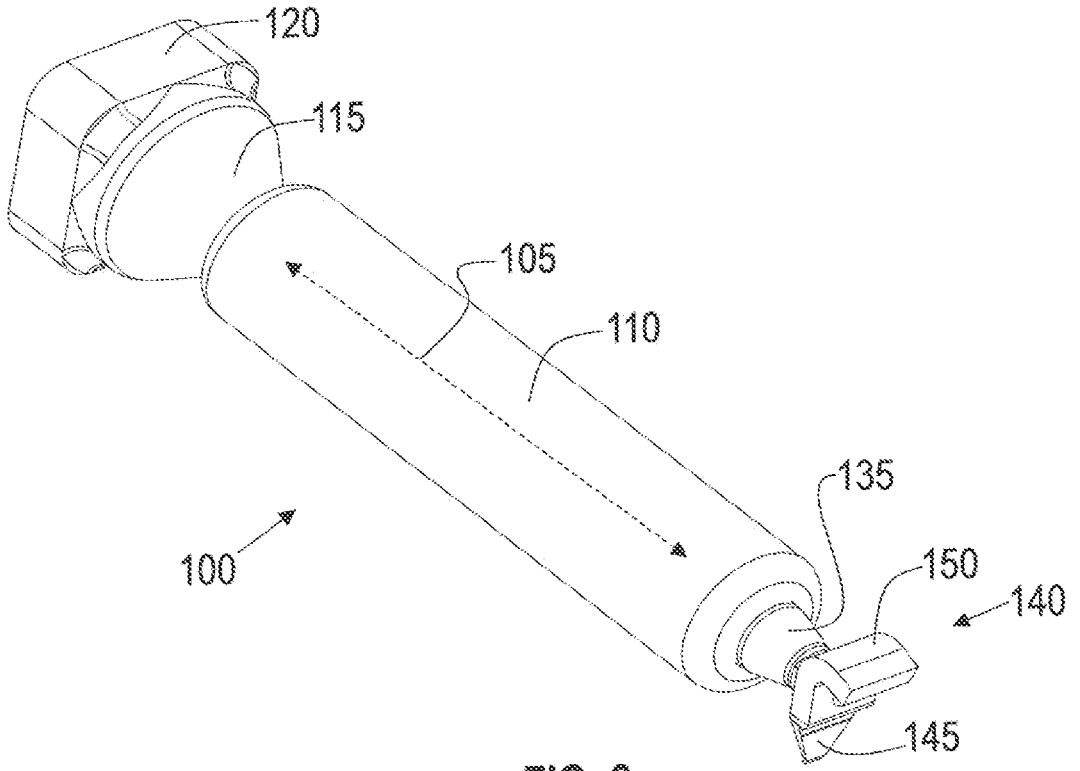
FIG. 2 shows another perspective view of the example clip tool of FIG. 1.

FIG. 2 shows another perspective view of the example clip tool 100 of FIG. 1 in which the tool 100 is rotated 180 degrees about the longitudinal axis 105 from the position of the tool 100 shown in FIG. 1.

Figure 3:
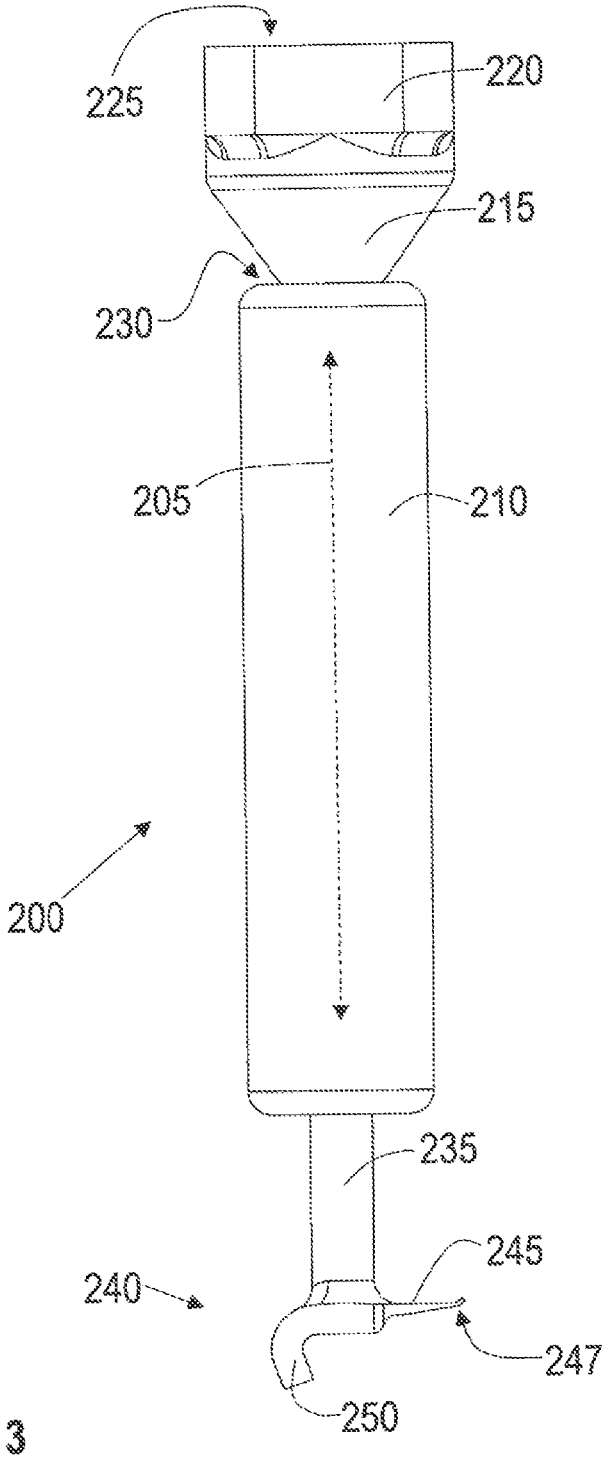
FIG. 3 shows a side view of another example clip tool.

FIG. 3 shows a side view of another example clip tool 200. The tool 200 includes several like elements described in detail above with respect to the tool 100 shown in FIGS. 1 and 2, including a handle 210, a hammer head 220 attached to the handle 210 at a handle end 230 by a head support 215, and a tool head 240 attached to the handle 210 at the opposite end of the handle 210 from the head support 215, where the tool head 240 includes a clip retaining portion 250 and a clip extrication element 245.

The side view of the tool 200 shown in FIG. 2 shows a substantially flat hammering surface 225 at the end of the hammer head 220. The hammering surface 225 can be used to strike objects, such as clips, can lids, or the like. Although the hammering surface 225 shown in FIG. 2 is oriented substantially perpendicular to a longitudinal axis 205 of the handle 210, it may be oriented parallel to the longitudinal access 205. Additionally, in some implementations the hammering surface 225 may have a crest in its center such that it is not entirely flat, which may enhance a user's ability to forcefully strike an object with the hammer head 220. The hammering surface 225 may be constructed from a like or different tool material than the hammer head 220. However, the hammering surface 225 is preferably constructed from a hard or resilient material, such as carbon steel, capable of impacting objects without deforming. In other implementations, the tool 200 can be constructed without the head support 215 such that the hammer head 220 is directly affixed to the end 230 of the handle. In yet other implementations, the end 230 of the handle 210 may be constructed with one or more tool materials such that it may operate as a hammering surface.

An elongate neck 235 attaches the tool head 240 to the handle 210. The neck 235 is longer than the neck 135 of the tool 100 shown in FIGS. 1 and 2. The longer neck 235 may allow a user of the tool to apply more force during rotation of the tool head 240 when using the clip retaining portion 250 and a clip extrication element 245 because it permits a person to rotate the handle 210 from a position further from the fulcrum of the tool head 140. The elongate neck 235 may take any shape, such as solid, or hollow, and its cross-section perpendicular to the longitudinal axis 205 may be cylindrical, square, rectangular, or another shape. Further, the neck 235 may be constructed of one or more tool materials.

FIG. 3 illustrates also a side view of the clip retaining portion 250 and clip extrication element 245. The clip extrication element 245 includes a tip 247 at a distal end of the clip extrication element 245, located opposite the portion of the clip extrication element 245 closest to the clip retaining portion 250. As shown in FIG. 3, the tip 247 is preferably thin in its thickness, as measured from its top to bottom along the longitudinal axis 210, to enhance the tool's 200 ability to slide the clip extrication element 245 under a small space, such as a space underneath an object, for instance, a clip that has been applied to an article. According to some implementations, the thickness of the tip may be 5 mm or less though it will be appreciated that more substantial thickness may also be used to strengthen the tip, which may be necessary for prolonged and/or repeated use. The tip 247 can also include a bend defining a bent portion of the tip 247, where the bent portion of the tip 247 is pointed toward the handle. This may assist the tip 247 in engaging and removing clips or other objects.

Figure 4:
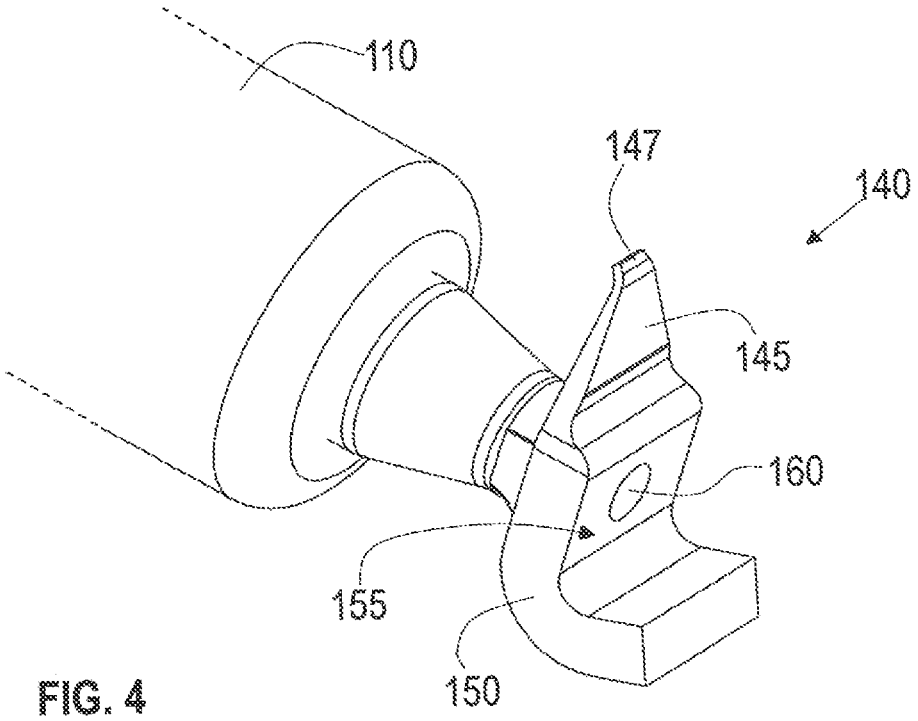
FIG. 4 shows a perspective view of a tool head of the example clip tool of FIG. 1.

FIG. 4 shows a perspective view of a tool head 140, attached to the handle 110, of the example clip tool 100 of FIGS. 1 and 2. As previously described, the tool head 140 includes a clip extrication element 145 and a clip retaining portion 150. The clip extrication element 145 can include a tip 147, similar to the tip 247 described with respect to FIG. 3. In the implementation shown in FIG. 4, the clip extrication element 145 and tip 147 may form a V-shape. The clip extrication element 145 and tip 147 may also be tapered in thickness from an area nearest the center of the tool head 140 to the distal end of the clip extrication element 245.

The tool head 140 includes a retaining element 160. As shown in FIG. 4, the retaining element 160 is disposed within the clip abutment portion 155 of the clip retaining portion 150. The location of the retaining element 160 in the clip abutment portion 155 allows the retaining element 160 to retain a clip proximate to the clip abutment portion 155 when the tool 100 is used to apply a clip. In some implementations, the retaining element 160 may include a magnet operable to engage a clip constructed of a ferromagnetic material. In other implementations not illustrated in FIG. 4, the retaining element can include one or more lobes or protrusions extending from the sides of the clip retaining portion 150 toward the clip abutment portion 155 that engage the edges of a clip such that a clip is frictionally maintained in position adjacent to the clip abutment portion 155. The one or more lobes or protrusions may be constructed with the clip retaining portion 150 from a single piece of material. Alternatively, the one or more lobes or protrusions may be frictionally attached to the clip retaining portion so that clips of different sizes may be accommodated.

Figure 6:
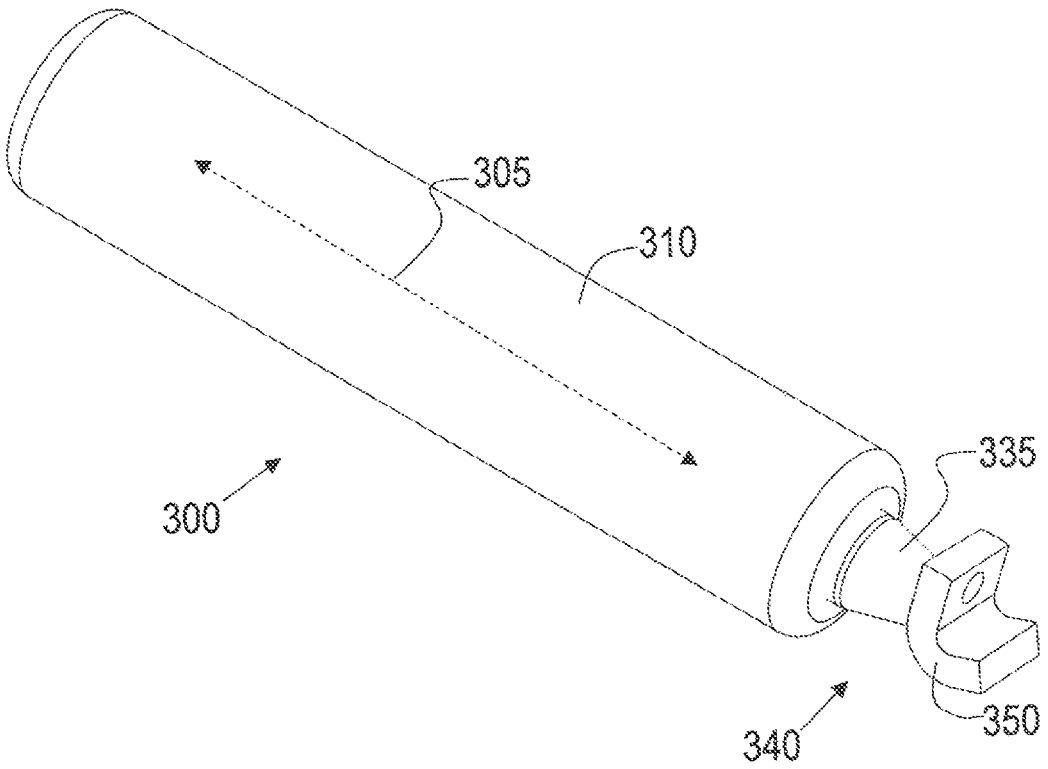
FIG. 6 shows a perspective view of an example clip tool.

Although the retaining element 160 is disposed within the clip abutment portion 155 in the implementation shown in FIG. 6, in other implementations the entire clip retaining portion 150 may be the retaining element. For instance, the entire clip retaining portion 150 may be constructed of magnetic tool materials. In other implementations, the entire clip abutment portion 155 may be constructed of magnetic materials. The tool head 140 can therefore include a combination of tool materials, as described above, including magnetic and non-magnetic materials.

Figure 5:
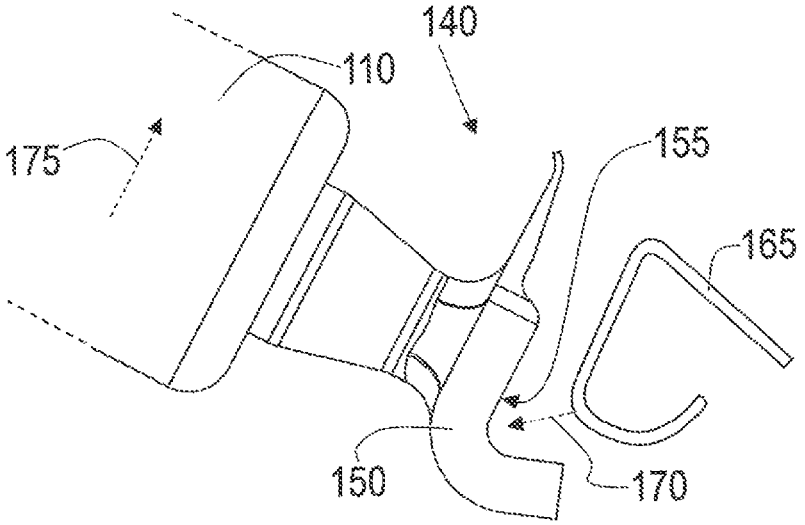
FIG. 5 shows the side view of an example clip proximate to the tool head of FIG. 4.

FIG. 5 shows the side view of an example clip 165 proximate to the example tool head 140 shown in FIGS. 1, 2, and 4. The clip 165 is constructed of a ferromagnetic material. The clip retaining portion 150 is operable to retain the clip 165 when the clip is moved 170 in close proximity to the clip abutment portion 155. For instance, a magnet (not shown in the side view of FIG. 5) disposed within the clip abutment portion 155 can attract and hold the clip 165 when it is moved 170 near the clip retaining portion 150.

In some implementations, after the clip 165 is held in place by the magnet, proximate to the clip abutment portion 155, the tool may be used to apply a clip. Because the clip retaining portion 150 is configured to mimic the shape of two sides of the clip 165 when the clip 165 is secured against the clip abutment portion 155, the tool head 140 can both hold the clip 165 in place and apply force to the clip 165 while the clip 165 is being secured to an article. For instance, when a user moves the handle 110 in the direction illustrated by dashed line 175, the clip abutment portion 155, including the flat and curved surfaces of the clip abutment portion 155, can exert force on the clip 165 in the same direction of the handle movement, to enable placement of the clip 165. The tool head 140 acts as a fulcrum and the handle 110 provides a user with leverage to secure the clip, such as securing a paint can clip to hold a paint can lid in place on a paint can. Additionally, once the clip 165 is in place, the handle may be proved in the opposite direction such that the clip 65 is released as the tension of the installed clip 165 exceeds the strength of the magnetic force applied by the magnet to the clip 165. In other implementations where one or more lobes or protrusions are used in place of a magnet, as described above, the release of a clip may occur after the tension provided by an installed clip exceeds the strength of the force applied by the one or more lobes or protrusions.

FIG. 6 shows a perspective view of an example clip tool 300. The example clip tool 300 includes a handle 310 and a tool head 340 secured to the handle 310 by a neck 335. The tool head 340 includes a clip retaining portion 350, at least one surface of which is positioned substantially perpendicular to a longitudinal axis 305 of the handle 310. The structure and operation of the handle 310, tool head 340, and clip retaining portion 350 in the tool 300 implementation shown in FIG. 6 are similar to the structure and operation of like components described above. However, the tool head 340 of the tool 300 does not include a clip extrication element. Further, the tool 300 does not include a hammer head attached to the end of the handle 310 opposite the tool head 340. Nevertheless, it will be appreciated that one or more of the features of the tools described herein, including with respect to FIGS. 1-5, may be implemented in combination with the tool 300 shown in FIG. 6.

While this specification contains many specifics, these should not be construed as limitations on the scope of what being claims or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Particular embodiments of the subject matter described in this specification have been described. Other embodiments are within the scope of the following claims.

The invention claimed is:

1. A tool, comprising:

a handle, having a longitudinal axis;

a tool head, attached to a first end of the handle, the tool head including:

a clip retaining portion, the clip retaining portion including;

a clip abutment portion having:

at least one flat surface operable to substantially abut at least a first side of a curved clip, wherein the longitudinal axis of the handle extends through the at least one flat surface; and at least one curved surface operable to abut a curved portion of the curved clip, said at least one flat surface and at least one curved surface comprising a homogeneous surface for retaining the curved clip, wherein the at least one flat surface and wherein the at least one curved surface are configured to apply forces in respective different directions to the curved clip as the handle is rotated; and a magnet, wherein the magnet is configured to retain the clip proximate to the clip abutment portion.

2. The toot of claim 1, further comprising a clip extrication element, extending from the clip abutment portion and including a tip.

3. The tool of claim 2, further comprising a hammer head attached to a second end of the handle by a head support, wherein the second end of the handle is opposite the first end of the handle.

4. The tool of claim 3, wherein the hammer head comprises a hammering surface positioned substantially perpendicular to the longitudinal axis of the handle.

5. The tool of claim 2, wherein the clip extrication element extends from the at least one flat surface of the clip abutment portion.

6. The tool of claim 5, wherein the tip includes a tapered portion.

7. The tool of claim 5, wherein the clip extrication element is disposed substantially perpendicular to the handle.

8. The tool of claim 1, further comprising a hammer head attached to a second end of the handle by a head support, wherein the second end of the handle is opposite the first end of the handle.

9. The tool of claim 8, further comprising a clip extrication element, extending from the clip abutment portion.

10. The tool of claim 8, further comprising a neck, located between the handle and the tool head, wherein the neck attaches the tool head to the handle.

11. The tool of claim 8, wherein the magnet is disposed entirely within the clip abutment portion.

12. The tool of claim 8, further comprising a clip extrication element having a tip, wherein the tip is pointed toward the handle.

* * * * *